United States Patent [19]

Kuenzli

[11] 4,206,342

[45] Jun. 3, 1980

[54] ELECTRODE-TYPE STEAM GENERATOR

[75] Inventor: Albert Kuenzli, Wiesendangen, Switzerland

[73] Assignee: Sulzer Brothers Ltd., Winterthur, Switzerland

[21] Appl. No.: 886,056

[22] Filed: Mar. 13, 1978

Related U.S. Application Data

[62] Division of Ser. No. 740,659, Nov. 10, 1976, Pat. No. 4,121,090.

[30] Foreign Application Priority Data

Sep. 23, 1976 [CH] Switzerland ..... 12057/76

[51] Int. Cl.[2] ..... H05B 3/60; F22B 1/30

[52] U.S. Cl. ..... 219/284; 219/288; 219/294; 338/80

[58] Field of Search ..... 219/271-276, 219/284-295; 122/13 A, 4 A; 338/80-86

[56] References Cited

U.S. PATENT DOCUMENTS 4,121,090 10/1978 Kuenzli ..... 219/284

FOREIGN PATENT DOCUMENTS 897317 11/1953 Fed. Rep. of Germany ..... 219/288

518502 1/1921 France ..... 219/288

*Primary Examiner*—A. Bartis

*Attorney, Agent, or Firm*—Kenyon & Kenyon

[57] ABSTRACT

An electrode steam generator of the type wherein water is directed in free fall from a water distribution device in a stream onto an electrode to generate steam employs a horizontal dish-shaped water distribution device having a circular rim defining a dam to cause a shroud of water to fall onto an electrode of either S-shaped transverse cross section or onto an annular electrode having a convex curvature. The water distribution device receives water from a load proportional supply means and the water overflows the dam in unthrottled manner for all loads of the steam generator. The rim defining the dam is rounded in a downward direction with the curvature thereof extending in each radial plane up to a point with an approximately vertical tangent. A portion of the water falling on the electrode is diverted to provide a gap to allow the release of steam generated within the water shroud.

5 Claims, 12 Drawing Figures

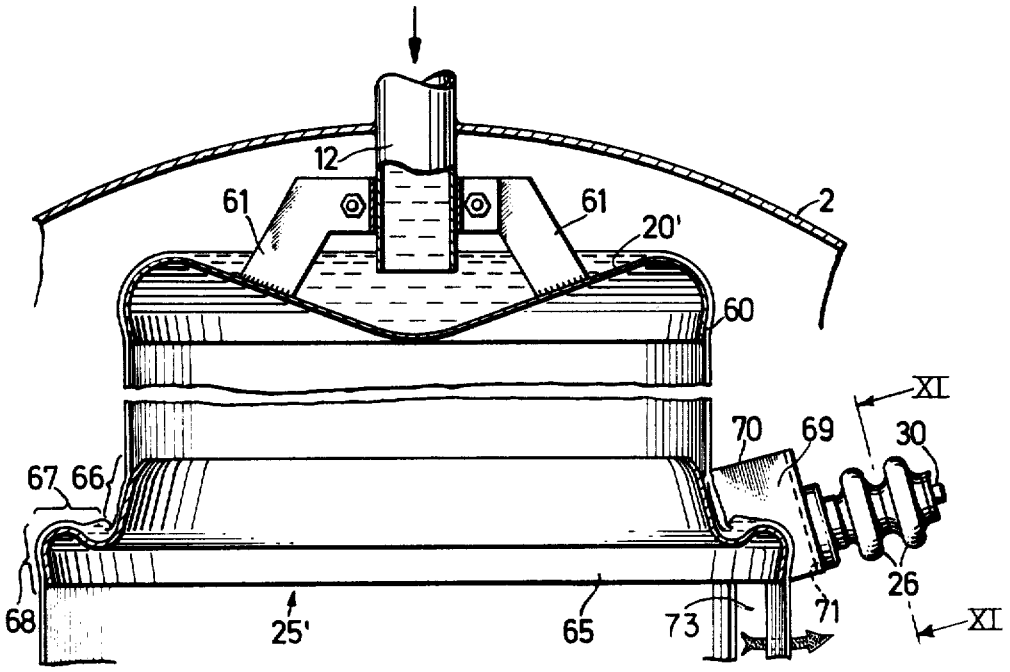
FIG. 5
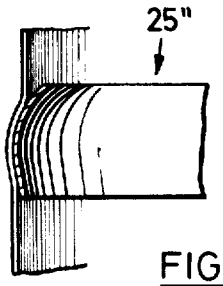
FIG. 6
FIG. 7
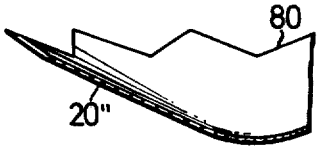
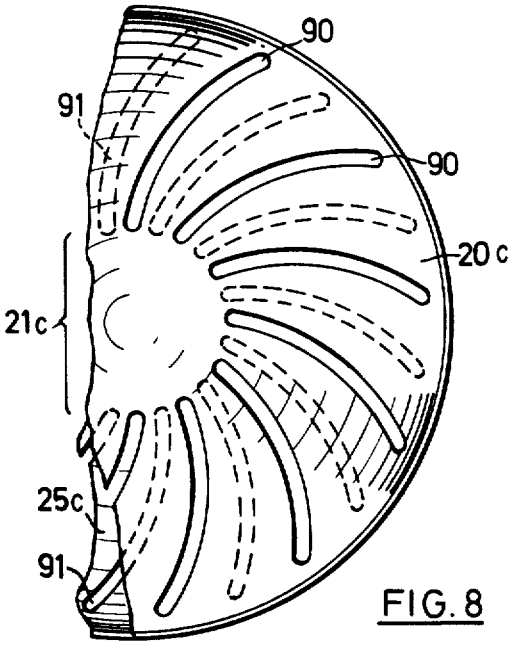
FIG. 8

ELECTRODE-TYPE STEAM GENERATOR

This is a division of application Ser. No. 740,659 filed Nov. 10, 1976 now U.S. Pat. No. 4,121,090.

This invention relates to an electric steam generator.

Electric steam generators have been known in which water is directed to fall from a water distribution device in streams or jets onto an electrode in order to generate steam. In one known electric steam generator, as described in copending patent application Ser. No. 719,416 of Sept. 1, 1976 provided in the water distribution device which are separated from each other by dam plates with a horizontal overflow edge. In addition, the overflow edges are located at increasing heights in a stepwise manner in the inflow direction of the water and at least one outlet nozzle is provided in the bottom of each compartment through which the water falls freely but throttled in the form of a calibrated jet onto the electrode located underneath. The electrode is also subdivided into compartments with dams of the same height and at least one outlet nozzle is provided in the bottom of the compartments through which the water passes onto a collecting grid, again in free fall and as a calibrated jet. Should a change occur in the load of the steam generator, the amount of water supplied to the distribution device is changed and thereby, the number of water jets, as more or fewer compartments of the distribution device are filled with water. However, because the load usually changes continuously but the number of water jets can be changed only in steps, the problem arises that under certain load conditions, some compartments are not filled completely. Thus, the discharge from their nozzles does not take place uniformly but only in dropwise manner or in surges.

Accordingly, it is an object of the invention to improve a steam generator of the aforementioned type in such a manner that the total flow cross section of the water falling from the distribution device can be adapted without steps if the load is changed.

It is an object of the invention to provide an electric steam generator of simple construction.

It is another object of the invention to avoid the use of water discharge nozzles in an electric steam generator.

It is another object of the invention to reduce the cost of constructing an electric steam generator.

Briefly, the invention provides an electric steam generator which employs at least one horizontal dish-shaped water distribution device which defines a dam to permit water in the device to overflow at least a part of the dam in unthrottled manner for all loads of the steam generator. In addition, the steam generator has a load-proportional water supply means for supplying water to the distribution device and an electrode below the distribution device for receiving water overflowing the dam in free fall.

In use, the water to be evaporated collects at the lowest point of the dish-shaped distribution device and leaves the device if the water level has reached the lowest point of the overflow edge defining the dam. With increasing load, the level in the distribution device rises and the water shroud leaving the device changes in dimension continuously and, thereby, the total flow cross section of the falling water.

The rim is rounded in a downward direction with the curvature thereof extending in each radial plane up to a point with an approximately vertical tangent. In addition, the distribution device has a shallow conical surface within the rim which is opened towards the top to receive the water from the water supply means.

The electrode may be of S-shaped transverse cross-section so as to receive the descending shroud of water from the distribution device.

In another embodiment, the electrode is constructed as an annular electrode having a convex curvature on which the water from a distribution device impinges.

The electrode can be supported on a suitable rod which is fixed to the electrode at a point over which a roof-shaped sheet is disposed so as to intercept and divert a portion of the water falling on the electrode and thus provide a gap to allow the release of steam within the water shroud.

These and other objects and advantages of the invention will become more apparent from the following detailed description and appended claims taken in conjunction with the accompanying drawings in which:

FIG. 5 illustrates a vertical cross sectional view through another embodiment of the distribution device and the electrode according to the invention;

FIG. 6 illustrates a modified detail of the electrode of FIG. 5;

FIG. 7 illustrates a vertical cross section through a further embodiment of a distribution device having a serrated rim in accordance with the invention;

FIG. 8 illustrates a top view of a further embodiment of the distribution device and the electrode in accordance with the invention;

Figure 1:
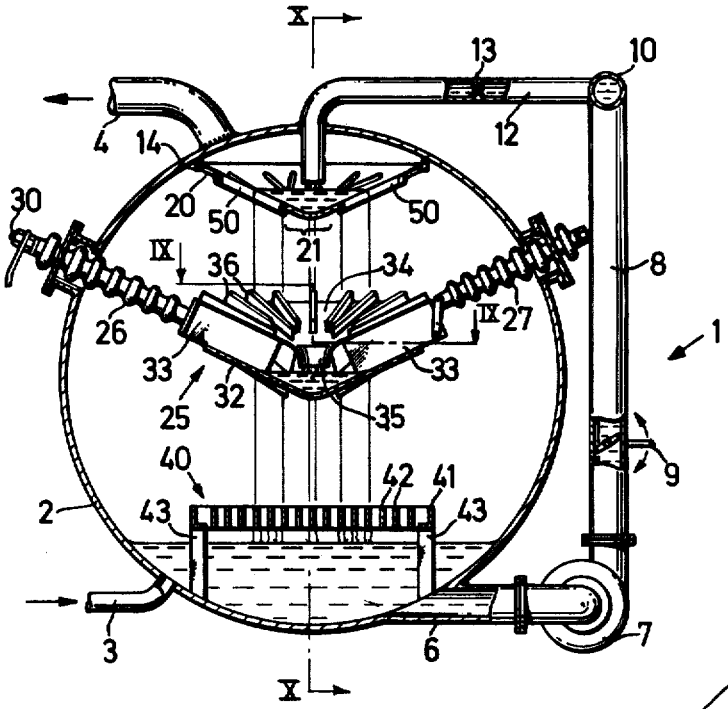
FIG. 1 illustrates a vertical cross sectional view of an electric steam generator according to the invention.
Figure 10:
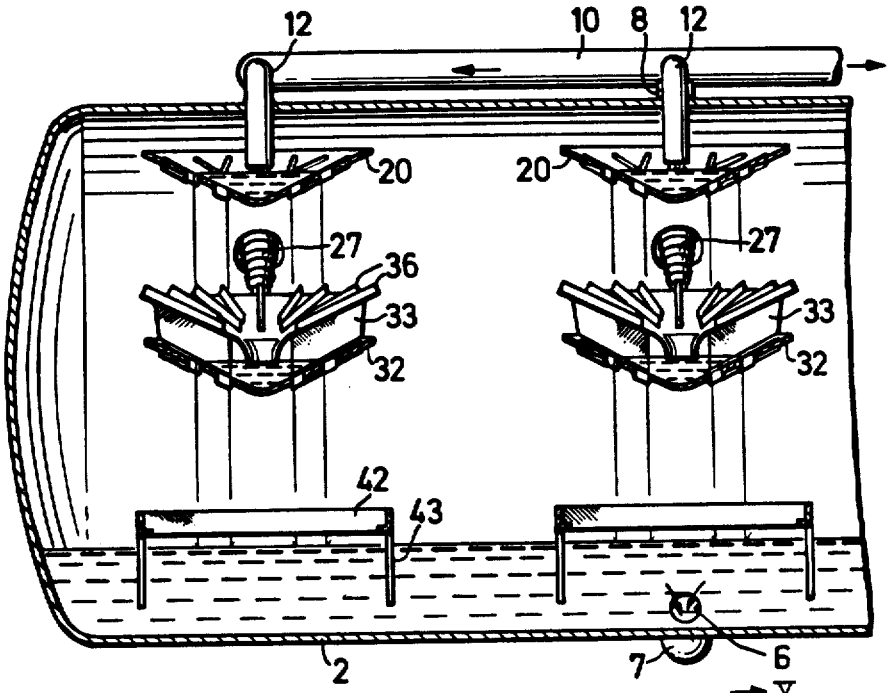
FIG. 10 illustrates a vertical sectional view taken on line X—X of FIG. 1.

Referring to FIG. 1, the electric steam generator has a horizontal, cylindrical vessel 2 to which feed water is fed into a sump at the bottom via a line 3 and from which steam is taken off at the top via a line 4. The water is taken from the sump via a connecting stub 6 and is returned to the vessel 2 by means of a circulating pump 7 via a riser 8 which contains a throttle 9, a distribution line 10 running perpendicularly to the plane of the drawing, and three branch lines 12 which branch off from the line 10 and lead to the top of the vessel 2. Each of the branch lines 12, of which only one is visible in FIG. 1, and two are visible in FIG. 10 is equipped with a choke member 13. A horizontal, dish-shaped distribution device 20 is arranged in the vessel 2 underneath the mouth of each branch line 12.

Each distribution device 20 consists of sheet metal and is constructed as a shallow conical surface which is open toward the top. The distribution device 20 is fastened at the rim to the vessel 2 via two sheet metal lugs 14, for instance, by welding. An electrode 25 is arranged at about half the height of the vessel 2 underneath each distribution device 20. Each electrode 25 is supported by two insulators 26, 27. A rod 30 is disposed inside the insulator 26 and serves as a rod-shaped conductor for supplying the electrode 25 with current. The three electrodes 25 are connected via the rods 30 to the three phases of a three-phase network (not shown).

Collecting grids 40 are provided in the vessel 2 underneath each electrode 25. Each grid 40 consists of a frame 41 and strip steel bars 42 which are arranged in parallel to each other and are mounted on edge. The frames 41 rest in the vessel 2 via legs 43.

Figure 2:
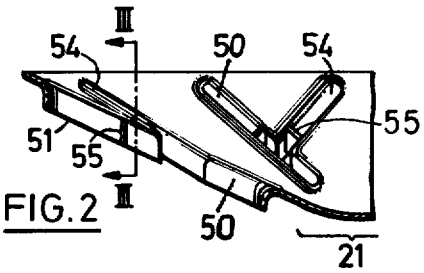
FIG. 2 illustrates a vertical cross sectional view through a dish-shaped distribution device of FIG. 1.

Each dish-shaped distribution device 20 defines a dam to permit water to overflow at least a part of the dam in unthrottled manner for all loads of the steam generator. To this end, the cone of each dish-shaped distribution device 20 has a rounded apex which forms a tray with the central zone 21 in which the water to be evaporated collects. In addition, each distribution device 20 has slots 50 which start out from the central region 21 and extend approximately radially up to the vicinity of the rim of the distribution device 20. As shown in FIG. 2, an auxiliary slot 54 extends from each radial slot 50 in angular relation and also extends to near the rim of the distribution device 20. Each slot 54 branches off from the slot 50 at about half the length of the latter. The slots 50, 54 together have the shape of a Y. Six such Y-shaped slots, for instance, are distributed over the circumference of each distribution device 20.

Figure 3:
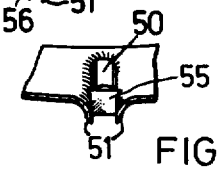
FIG. 3 illustrates a detail of the device in a cross section according to the line III—III in FIG. 2.

Referring to FIGS. 2 and 3, the slots 50, 54 are pushed out of the wall of the distribution device 20 in a downward direction in such a manner that large radii are obtained on the top side and on the underside, while the rims 51 of the slots end in the vertical direction. In order to increase the stiffness of the slots, cross-pieces 55 are fastened in the slots 50, 54. The dish-shaped device 20 together with the central region 21 therefore forms a dam, the overflow edge of which is defined by the edges of the slots 50, 54. The lower end of all slots 50 is at the same height. For reasons of strength, the slots do not continue all the way to the rim.

Figure 9:
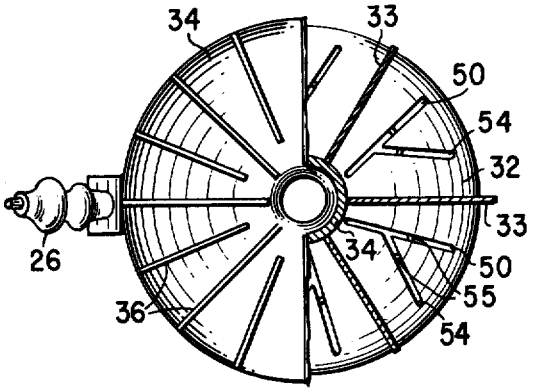
FIG. 9 illustrates a view of the electrode of FIG. 1 partly in cross section.

As is shown in FIG. 9, also the electrode 25 is constructed as a dish-shaped distribution device 32 which has the same shape as the distribution device 20. In addition, a collecting dish 34, which is connected to the distribution dish 32 via six radial web plates 33, is arranged on the top side of the electrode 25. The collecting dish 34 has a funnel-shaped outlet 35 at the center. In addition, the collecting dish 34 is provided on the top side with radial fins 36 which start out from the edge of the dish 34 and extend toward the center. The fins 36 serve to increase the surface area of the dish 34.

In the operation of the steam generator, water is pumped from the sump of the vessel 2, by means of the circulating pump 7, into the dish-shaped distribution device 20, where the water at first collects in the central region 21. If the load of the steam generator is low and the circulation is therefore small, the water overflows in layers only through the lower section of the slots 50. The escaping water falls in free fall onto the collecting dish 34 of the associated electrode 25. The water is collected in the collecting dishes 34 and is conducted via the funnel 35 to the distribution dish 32 of the electrode 25 located underneath the funnel 35. From the dish 32, the water then passes, again in layers and in free fall to the associated collected grid 40. The electric current flows from the electrodes 25 through the falling water layers to the distribution device 20 and in the same direction as the falling water layers to the collecting grid 40. With this flow of the current, part of the water evaporates and the saturated steam which is generated is conducted to a consumer (not shown) via the line 4.

The amount of circulated water can be adapted to the prevailing load of the steam generator by setting the throttle 9. If the circulated quantity is large, a high water level adjusts itself in the distribution device 20. The water is then admitted to the sections of the slots 50 situated further upward as well as to the lower sections of the slots 54. Thus, the total cross section of all the layer-shaped water jets becomes larger without steps. The current drawn by the steam generator and therefore also the output of the steam generator, thereby increase continuously. The energy converted in the steam generator increases the enthalpy of the water. Due to the Y-arrangement of the slots 50, 54, the saturated steam produced can easily flow off to the outside without taking along substantial quantities of water.

Figure 4:
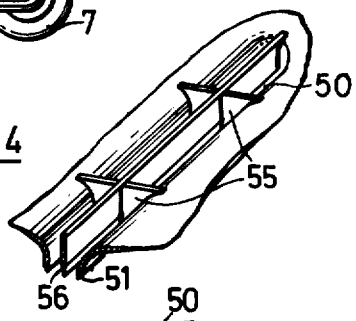
FIG. 4 illustrates a perspective view of a modified detail of the device as per FIG. 2.

Because of the large radius of the slots 50 and 54, shown in FIG. 3, a smooth, layer-shaped jet is obtained. To make the jet laminar, a vertical center web 56 which runs crosswise to cross pieces 55 and has about the same height as the cross-pieces 55 may be provided parallel to the slot as is shown in FIG. 4.

Figure 11:
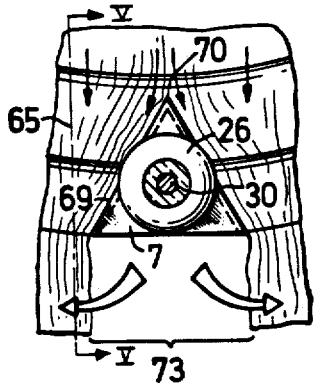
FIG. 11 illustrates a view taken on line XI—XI of FIG. 5.

Referring to FIG. 5, the dish-shaped distribution device 20' may alternatively be constructed without slots. As shown, the distribution device 20' has the shape of a shallow conical surface open toward the top with a rounded apex. In this embodiment, the water overflows the rim 60 of the distribution device 20'. For this purpose, the rim 60 is rounded in a downward direction, the curvature extending in each radial plane up to a point with an approximately vertical tangent. The distribution device 20' is clamped via two brackets 61 to the end of the branch line 12 which extends into the vessel 2. The electrode 25' located underneath the distribution device 20' consists of a sheet metal ring 65 with an approximately S-shaped cross section which, in a first section 66, runs steeply upward and is convex. In the middle section 67, which follows the lower end of the section 66, the S-shaped cross section runs outward with a concave-convex curvature. The middle section 67 is followed by a third section 68, which is directed downward and has a slightly conical shape. At one point of the circumference of the electrode 25', a roof-shaped sheet 69 is welded on. This sheet 69 has a ridge 70 that is inclined toward the section 66. The free end of the roof sheet 69 is closed off by a triangular metal plate 71 (see also FIG. 11) to which one end of the rod 30 is fastened. The rod 30 is surrounded by the insulator 26 and supports the electrode 25'.

In this embodiment, the water fed to the distribution device 20' via the branch line 12 falls like a shroud over the rim 60 which forms a smooth overflow in the horizontal direction, onto the section 66 of the electrode 25' and then passes to the collecting grid (not shown) along the middle section 67 and the third section 68. The steam released in the interior of the tubular water shroud flows off through the gap 73 (FIG. 11) formed in the shroud underneath the roof sheet 69 and then passes to the line 4. If the load changes, the length of the water shroud remains constant and only the thickness of the water layer changes.

If no small partial load is called for, an electrode 25'' such as is shown in FIG. 6, can also be used instead of the electrode 25'. The annular electrode 25'' consists only of a part with a convex curvature.

Referring to FIG. 7, the dish-like distribution device 20", which is shaped according to a shallow conical surface, may alternatively be provided with a rim 80 which is serrated in star-fashion and defines the overflow edge of the dam formed by the wall of the dish. If the load of the steam generator is small and the water level in the distribution device 20" is accordingly low, freely falling water jets of approximately triangular cross section are produced; this cross section being relatively small. As the load increases, the level rises and the size of the cross section increases continuously. In general, this distribution device is constructed so that adjacent jets do not merge but gaps are left between them through which the steam within the circle of jets can flow off to the outside. Because the overflow edge can be located between two height levels, defined water jets are produced with very small loads. Further, as the quantity of water increases, the circumference of the cross section of falling water becomes larger. This favors a good and safe discharge of the steam.

Figure 12:
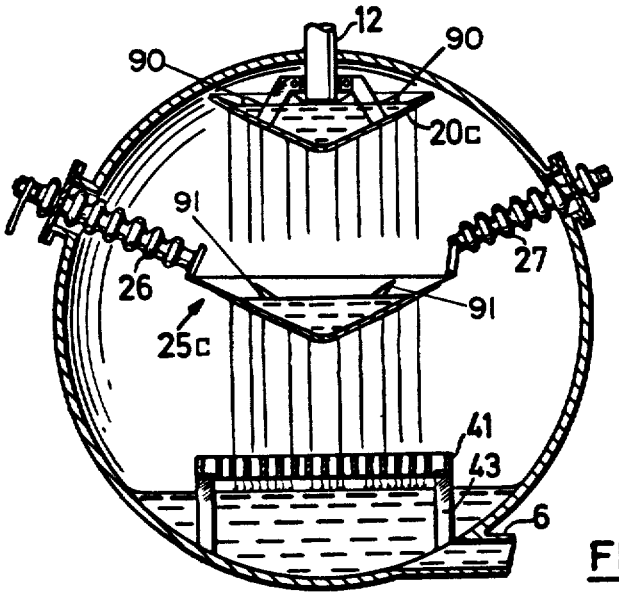
FIG. 12 illustrates a view of a distribution device of FIG. 8 in a steam generator similar to FIG. 1.

Referring to FIGS. 8 and 12, the dish-shaped distribution device 20c may be constructed with about the same shape as the distribution device 20 in FIGS. 1 and 2, but instead of having radial slots, the slots 90 are curved in involute-fashion. As shown, these slots 90 start out from the central region 21c of the distribution device and extend to near the rim of the device 20c. An electrode 25c of similar shape is arranged underneath the distribution device 20c with involute-like slots 91 displaced by half a pitch relative to the slots 90 in the distribution device 20c. The out-of-phase relation of the slots 90, 91 allows the layer-shaped water jets from the slots 90 to strike the electrode 25c between each pair of slots 91 of the electrode.

Instead of using three electrodes, the steam generator can be equipped with only one electrode. In this case, only one distribution device is provided above the electrode.

The invention is not limited to vessels with a horizontal axis. It is also possible to use vessels with a vertical axis. The dish-shaped distribution devices are then uniformly distributed about the axis. Similarly, the invention is not limited to distribution devices with conical dishes. Any other desired shapes are conceivable, for instance, toroidal dishes.

What is claimed is:

1. An electric steam generator comprising at least one horizontal dish-shaped water distribution device having a circular rim defining a dam to permit water in said device to overflow at least a part of said dam in unthrottled manner for all loads of the steam generator, said rim being rounded in a downward direction with the curvature thereof extending in each radial plane up to a point with an approximately vertical tangent;

a load-proportional water supply means for supplying water to said distribution device; and an electrode below said distribution device for receiving water overflowing said rim in free fall.

2. An electric steam generator as set forth in claim 1 wherein said distribution device has a shallow conical surface within said rim and open towards the top to receive water from said supply means.

3. The combination as set forth in claim 1 wherein said electrode includes a sheet metal ring with an approximately S-shaped transverse cross-section having an annular first convex section running steeply upward, a middle section of concave-convex curvature and a downwardly directed third section of slightly conical shape.

4. The combination as set forth in claim 3 wherein said electrode further includes a roof-shaped sheet on said ring, said sheet being generally V-shaped to define a ridge and positioned on the side of said electrode receiving water from said distribution device with said ridge uppermost and inclined toward the first section of said electrode; said sheet being disposed to intercept and divert a portion of the water falling onto said electrode from said water distribution device to create a gap in the water shroud falling from the third section of the electrode, thereby allowing steam released within the water shroud to escape, a metal plate closing off said sheet and a rod fastened to said plate to support said electrode.

5. The combination as set forth in claim 1 wherein said electrode includes an annular electrode having a convex curvature on which the water from said water distribution device impinges.

* * * * *